US010115280B2

(12) United States Patent
Bressanutti et al.

(10) Patent No.: US 10,115,280 B2
(45) Date of Patent: Oct. 30, 2018

(54) DETECTOR WITH OPTICAL BLOCK

(71) Applicant: Honeywell International Inc., Morristown, NJ (US)

(72) Inventors: Massimo Bressanutti, Sesto al Reghena (IT); Mauro Miheli, Trieste (IT); Andrea Chiatti, Trieste (IT)

(73) Assignee: LIFE SAFETY DISTRIBUTION AG, Hegnau (CH)

( * ) Notice: Subject to any disclaimer, the term of this patent is extended or adjusted under 35 U.S.C. 154(b) by 580 days.

(21) Appl. No.: 14/315,636

(22) Filed: Jun. 26, 2014

(65) Prior Publication Data

US 2015/0379846 A1 Dec. 31, 2015

(51) Int. Cl.
*G08B 17/10* (2006.01)
*G08B 17/107* (2006.01)
*G08B 17/113* (2006.01)

(52) U.S. Cl.
CPC ..... *G08B 17/107* (2013.01); *G08B 17/113* (2013.01)

(58) Field of Classification Search
CPC ..... G08B 17/107; G08B 17/113
USPC ..... 340/630
See application file for complete search history.

(56) References Cited

U.S. PATENT DOCUMENTS 5,400,014 A * 3/1995 Behlke ..... G08B 17/107 250/574
6,521,907 B1 * 2/2003 Shoaff ..... G08B 17/107 250/573
7,075,445 B2 * 7/2006 Booth ..... G08B 17/103 340/630
7,697,140 B2 * 4/2010 Iguchi ..... G01N 21/53 250/574
7,948,627 B2 5/2011 Iguchi et al.
8,743,366 B2 * 6/2014 Numao ..... G08B 17/10 356/246
2002/0089426 A1 * 7/2002 Qualey, III ..... G08B 17/107 340/628
2003/0001746 A1 * 1/2003 Bernal ..... G08B 17/107 340/630
2008/0018485 A1 * 1/2008 Kadwell ..... G08B 17/107 340/630
2012/0262714 A1 * 10/2012 Gonzales ..... G01N 21/53 356/338

(Continued)

FOREIGN PATENT DOCUMENTS

CN 103597525 A 2/2014
EP 1 327 966 A2 7/2003

(Continued)

OTHER PUBLICATIONS

Extended European search report for corresponding EP patent application 15170177.8, dated Oct. 28, 2015.
English-language translation of patent publication CN 103597525 A, publication date Feb. 19, 2014, patentee Fenwal Controls of Japan, Ltd.
English-language translation of patent publication JP 2013-54455, publication date Mar. 21, 2013, patentee New Cosmos Electric Corp.

(Continued)

*Primary Examiner* — Zhen Y Wu
(74) *Attorney, Agent, or Firm* — Husch Blackwell LLP

(57) ABSTRACT

An optical smoke detector includes a radiant energy source and a sensor. The source and the sensor are carried by an optical block that provides a fixed orientation therebetween and barriers therebetween. The barriers reduce noise and false alarming due to bugs, dust, water vapor, and other intrusive elements. The barriers can include V-shaped members at a selective angle relative to center lines of the source and the sensor.

13 Claims, 10 Drawing Sheets

(56) References Cited

U.S. PATENT DOCUMENTS

| | | | | |
|---|---|---|---|---|
| 2013/0286391 | A1* | 10/2013 | Erdtmann | G01N 21/53 356/341 |
| 2014/0085093 | A1* | 3/2014 | Mittleman | H04L 12/282 340/628 |
| 2014/0168647 | A1* | 6/2014 | Ju | G01N 21/53 356/338 |
| 2015/0302727 | A1* | 10/2015 | Piccolo, III | G08B 29/145 340/514 |
| 2015/0310732 | A1* | 10/2015 | Piccolo, III | G08B 29/145 340/515 |

FOREIGN PATENT DOCUMENTS

| | | | |
|---|---|---|---|
| EP | 2 725 565 | A1 | 4/2014 |
| GB | 2 397 122 | A | 7/2004 |
| JP | 2012-47753 | A | 3/2012 |
| JP | 2013-54455 | | 3/2013 |
| JP | 2013-168182 | | 8/2013 |
| JP | 5351232 | B2 | 11/2013 |
| KR | 10-1162803 | B1 | 7/2012 |
| KR | 10-2013-0143655 | A | 12/2013 |
| KR | 10-2014-0040601 | A | 4/2014 |
| RU | 57 942 | U1 | 10/2006 |
| RU | 128 754 | U1 | 5/2013 |
| TW | I387747 | B | 3/2013 |
| TW | 201329913 | A1 | 7/2013 |
| WO | WO 2013/030918 | A1 | 3/2013 |
| WO | 2014/068304 | A1 | 5/2014 |

OTHER PUBLICATIONS

English-language translation of patent publication JP 2013-168182, publication date Aug. 29, 2013, patentee Nohmi Bosai Ltd.

English-language translation of abstract for JP patent publication 2012-47753, dated Mar. 8, 2012.

English-language translation of abstract for JP patent publication 5351232, dated Nov. 27, 2013.

English-language translation of abstract for KR patent publication 10-1162803, dated Jul. 5, 2012.

English-language translation of abstract for KR patent publication 10-2013-0143655, dated Dec. 31, 2013.

English-language translation of abstract for KR patent publication 10-2014-0040601, dated Apr. 3, 2014.

English-language translation of abstract for TW patent publication I387747, dated Mar. 1, 2013.

English-language translation of abstract for TW patent publication 201329913, dated Jul. 16, 2013.

Office Action from corresponding RU patent application 2015122496, dated Apr. 28, 2018.

English-language translation of Office Action from corresponding RU patent application 2015122496, dated Apr. 28, 2018.

English-language translation of RU patent 57 942 U1, dated Oct. 27, 2006.

English-language translation of Abstract for RU patent 128 754 U1, dated May 27, 2013.

* cited by examiner

DETECTOR WITH OPTICAL BLOCK

FIELD

The application pertains to optically based smoke detectors. More particularly, the application pertains to such detectors that provide improved signal-to-noise ratios through a use of selectively configured optical blocks.

BACKGROUND

Various types of optical, scattering, smoke detectors are known. They provide useful warnings of developing smoke conditions. One such structure is disclosed in U.S. Pat. No. 6,521,907 ("the '907 patent"), entitled "Miniature Photoelectric Sensing Chamber", which issued Feb. 18, 2003 and is assigned to the assignee hereof. The '907 patent is incorporated by reference herein.

In summary, such optical smoke detectors or multi-criteria smoke detectors that use an optical signal to detect fire include a sensing chamber where smoke enters an optical system to detect light scattered by smoke particulate, possibly other transducers (thermistors, etc.), electronic control circuits, and a communication system to process signals from the transducers. Information from a detector can be transmitted to a fire alarm control panel. However, some types of detectors do not communicate with a control panel, but have an integrated alarm system.

In known smoke and fire detectors, the optical system includes an optical emitter and a receiver that are integrated with the sensing chamber of the detector through a use of an optic part holder. Among other functions, this part holder facilitates automatic assembly of the detector.

The optical system has to meet various needs and requirements to be suitable for its purpose. Known needs and requirements can include acceptable optical sensitivity to guarantee a good signal to noise ratio in a presence of smoke, immunity to small non-smoke particulate matter or bugs that enter the sensing chamber, and immunity to condensation and humidity.

Small size due to reduced chamber volume is an asset as is an ability to cost effectively assemble such detectors using automatic placement machines.

As those of skill will understand, the optical emitter and the receiver have to be located so that, without smoke, only a very little amount of light reaches the receiver after multiple reflections in the sensing chamber. On the other hand, in the presence of smoke, a sufficient amount of the light projected by the optical emitter is scattered by smoke particles and collected by the receiver so that the presence of smoke can be evaluated.

It has also been recognized that a variety of interfering phenomena can adversely impact a performance of such devices. These include dust, insects, or small objects that can enter the sensing chamber and cause a signal drift or false alarms. High humidity or condensation phenomena in the sensing chamber can also effect unwanted signal variations.

Different configurations of the optical system in commercial fire detectors are known. The optical emitter and the receiver can be soldered to a printed circuit board. An optical set-up is assured through the use of one or more molded optic part holders. The optic part holder can also reduce a beam of the light from the optical emitter in order to get a larger optical signal only in the presence of the smoke in the sensing chamber.

DETAILED DESCRIPTION

Figure 1:
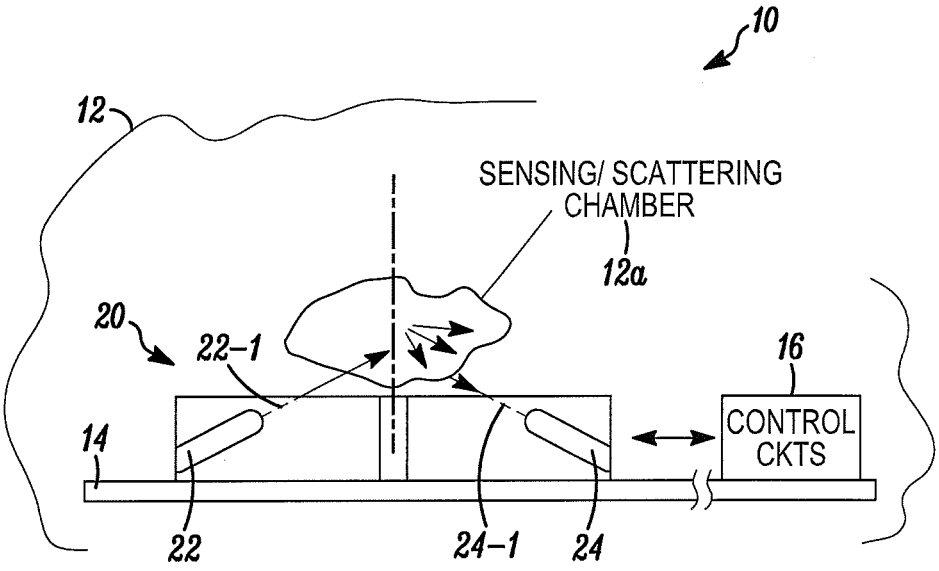
FIG. 1 is a side sectional view of a smoke detector in accordance herewith.
Figure 2:
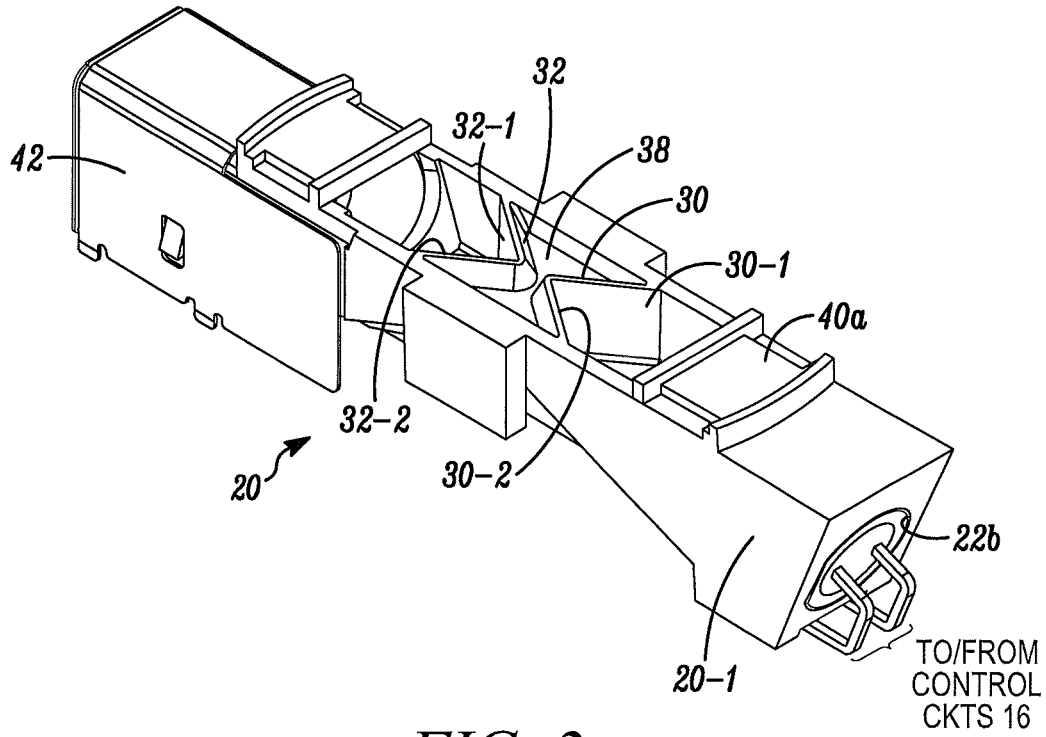
FIG. 2 is a perspective view of an optical block as in the smoke detector of FIG. 1.
Figure 3:
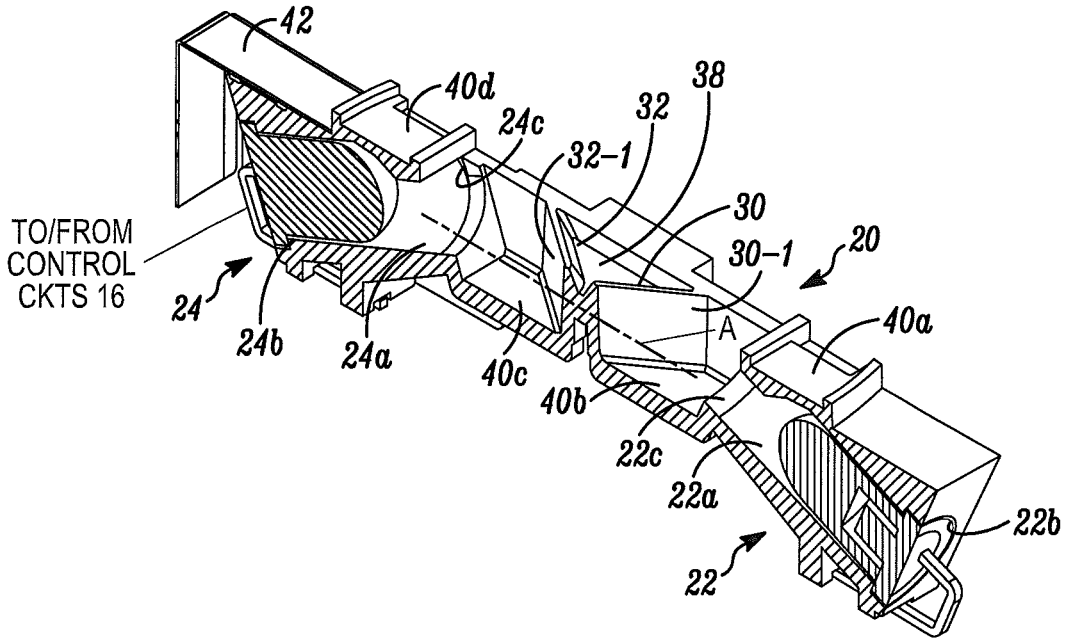
FIG. 3 is a sectional view of the optical block of FIG. 2.
Figure 4:
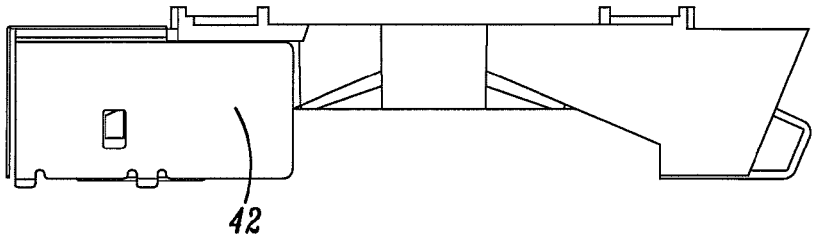
FIG. 4 is a side view of the optical block of FIG. 2.

While disclosed embodiments can take many different forms, specific embodiments hereof are shown in the drawings and will be described herein in detail with the understanding that the present disclosure is to be considered as an exemplification of the principles hereof and the best mode of practicing the same and is not intended to limit the claims hereof to the specific embodiment illustrated.

Embodiments hereof advantageously use an elongated optical block that is described below. In this molded optical block, a central portion provides spaced apart emitter and receiver zones. In a disclosed embodiment, two mirror-like V-shaped barriers—one nearer an emitter, the "emitter barrier", and one closer to a receiver, the "receiver barrier"—face one another.

The emitter barrier is directly illuminated by the emitter. Small objects that could enter a sensing chamber through an inflow filter settle on its upper surface and scatter light. However, this light is intercepted by the receiver barrier. On the other hand, the small objects or water droplets that settle on the receiver barrier are not directly illuminated by the emitter because they are under a shadow of the emitter barrier.

These two barriers are separated by a lower plane. The two barriers and lateral sides form a small basin or depression that can contain the small objects that enter a chamber filter, such as condensed water drops. This feature can prevent significant output signal variations.

A resulting effect is that condensation, dust, insects, or other small objects that could settle on the optical block do not cause a significant increase in an output optical signal.

As described below, a distance between the two barriers and their geometry are such as to maximize optical sensitivity and provide immunity to the condensation, the dust, the insects, and the other small objects that could enter the sensing chamber.

Four flat pick-up areas are provided on the optical block for an automatic placement of the optical block. Various pick-up processes are available for the automatic placement of the optical block. It is also possible to pick up the optical block with two different nozzles that aspire the optical block through upper or lower pick-up regions. It will be understood that an exact manufacturing process is not a limitation hereof.

The upper pick-up areas are bounded by two steps. As a result, drops formed by humidity condensation in these areas do not interfere with an emission radiation cone, thereby causing the output signal variations.

FIGS. 1-9 illustrate various views of a smoke detector and an optical block in accordance herewith. In FIG. 1, a scattering or diffraction type smoke detector 10 is illustrated. This smoke detector 10 includes an external housing 12 that carries a planar support member 14 that could be implemented as a printed circuit board 14. Control 16 carried by the planar support member 14 are coupled to an optical block 20.

With respect to FIGS. 2-9, the optical block 20 has a molded body member 20-1 and includes molded channels 22*a*, 24*a* that receive an emitter 22 via an input port 22*b* and a receiver sensor 24 via an input port 24*b*. The emitter 22 and the receiver sensor 24 have respective center lines 22-1, 24-1 that extend from the optical block 20 toward an adjacent sensing chamber 12*a*.

Emitted radiant energy from the emitter 22, which can include a light emitting or laser diode, exits the molded channel 22*a* via an output port 22*c*. Scattered radiant energy from the sensing chamber 12*a* travels via an input port 24*c* to the receiver sensor 24 where it is sensed and coupled to the control circuits 16 as would be understood by those of skill in the art.

A V-shaped emitter barrier 30 has two planar side surfaces 30-1, 30-2. A V-shaped receiver barrier 32 has two planar side surfaces 32-1, 32-2. The barriers 30, 32 are located displaced from respective ports 22*c*, 24*c* along a center line A of the optical block 20.

The emitter barrier 30 is directly illuminated by the emitter 22, which is intermittently energized by the control circuits 16. Small objects, dust, drops of water due to humidity and temperature changes, or bugs that might enter the sensing chamber 12*a* through an input filter, not shown, might settle on an upper surface and scatter light. Such scattered light will be intercepted by the receiver barrier 32 and not contribute to locally generated noise. Advantageously, such objects that settle on the receiver barrier 32 are not directly illuminated because they are under a shadow of the emitter barrier 30.

A depressed separation plane 38 provides a region into which such objects, including the drops of water, can fall; this plane directs them away from either the emitted radiant energy from the emitter 22 or that arriving at receiver sensor 24.

An optical sensitivity and immunity ratio can be adjusted to provide desirable optical sensitivity and good immunity to the dust, condensation, and the small objects that might settle on the optical block 20 by providing an emitter angle on an order of seventy degrees plus/minus twenty five degrees. A receiver angle can be adjusted accordingly. The receiver angle can vary from seventy degrees between plus one hundred ten degrees (straight barrier) and minus twenty five degrees.

Molding the described barrier planar side surfaces, such as 30-1, 30-2, 32-1, 32-2, so that substantially vertical barrier planes are formed is effective in avoiding settling of non-smoke particulate matter on edges of the barriers. This minimizes false alarms and output signal drifts. A slope between ninety degrees and sixty degrees relative to the center line A provides acceptable noise immunity.

Figure 6:
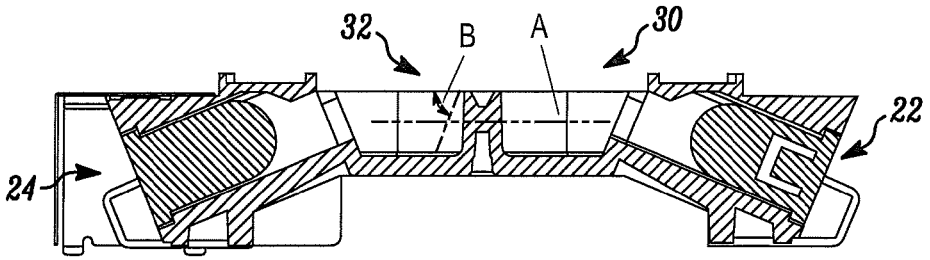
FIG. 6 is a top view of the optical block of FIG. 4.
Figure 7:
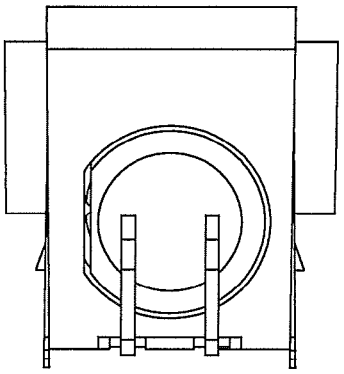
FIG. 7 is an end view of the optical block of FIG. 4.
Figure 8:
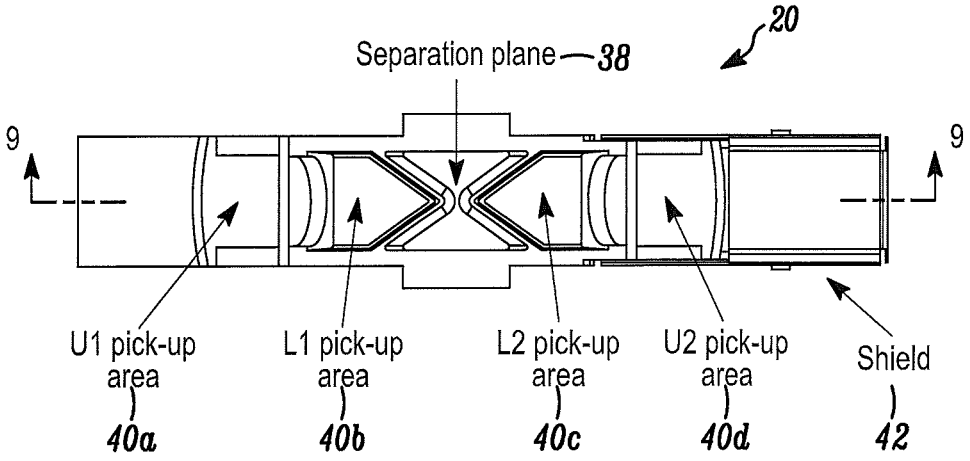
FIG. 8 is a top view of an optical block illustrating pick-and-place areas for automatic assembly.
Figure 9:
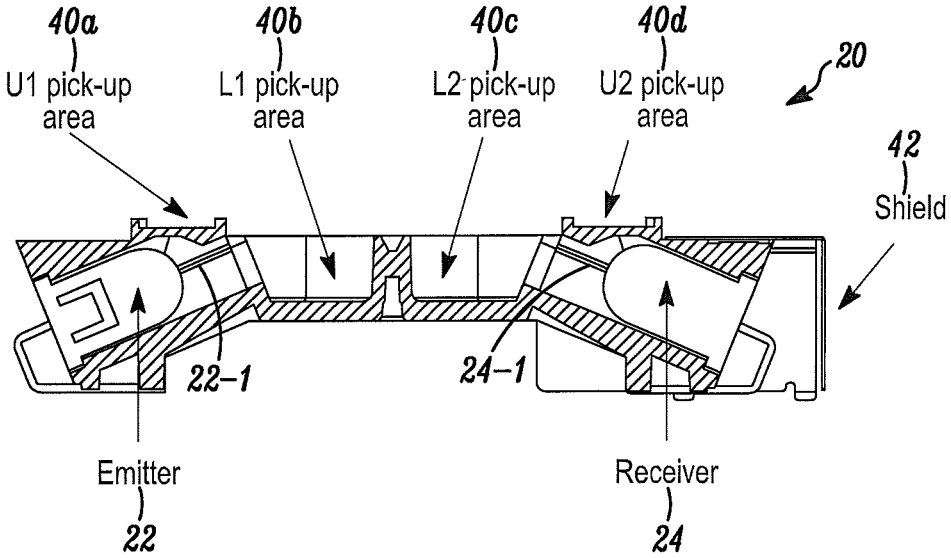
FIG. 9 is a side sectional view of the optical block of FIG. 8.

A plurality of pick-and-place areas 40*a*, 40*b*, 40*c*, 40*d* can also be provided to facilitate pick and place operations during an automatic assembly process. A U-shaped metal shield 42 can be attached to a receiver end of the optical block 20. This shield can partially enclose the receiver 24, isolating it from local noise generating electromagnetic waves. FIG. 6 includes the center line A of the optical block 20.

Figure 5:
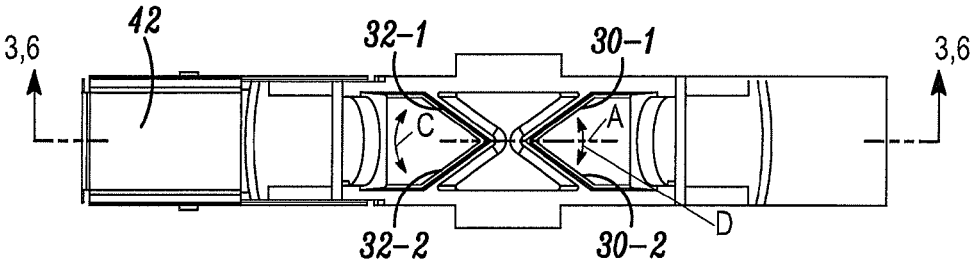
FIG. 5 is a sectional view of the optical block of FIG. 4.

While a variety of angular settings come within the scope and spirit hereof, with respect to FIGS. 5 and 6, an angle B, a barrier plane slope, is preferably in a range of sixty degrees to ninety degrees. An angle C is in the range of one hundred ten degrees to forty five degrees. An angle D is in the range of ninety five degrees to forty five degrees. Most preferably, the angle B will be on the order of ninety degrees, and the angles C and D will be on the order of seventy degrees.

Figure 10:
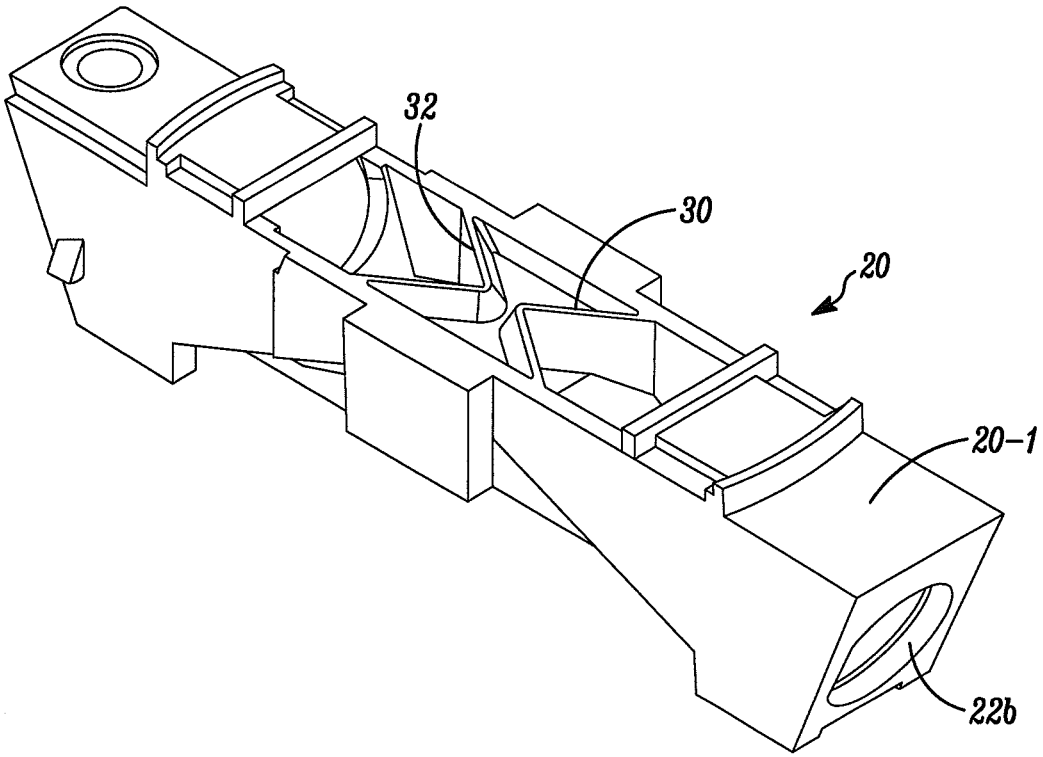
FIG. 10 is a perspective view of an optical block with a metal shield removed.
Figure 11:
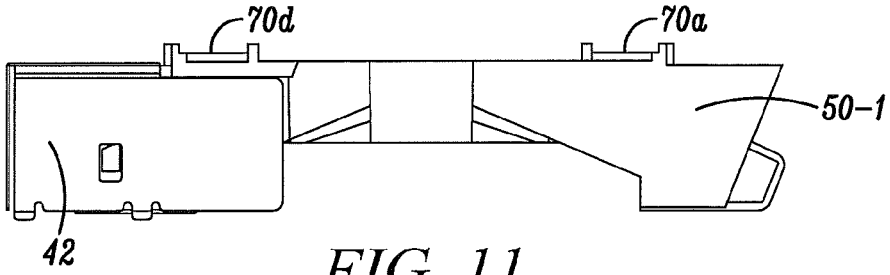
FIG. 11 is a side view of an alternate optical block in accordance herewith.
Figure 12:
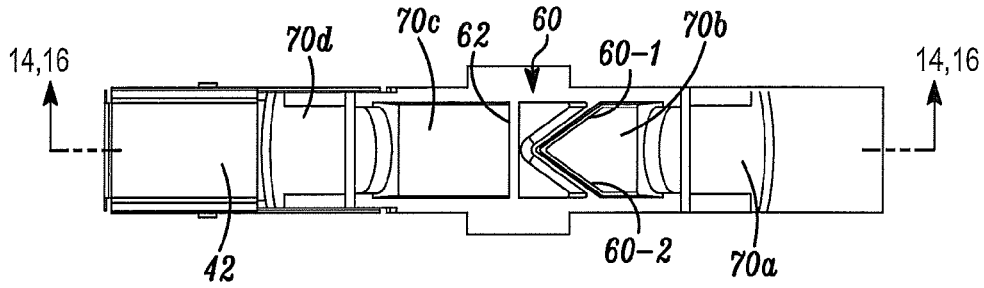
FIG. 12 is a top plan view of the optical block of FIG. 11.
Figure 13:
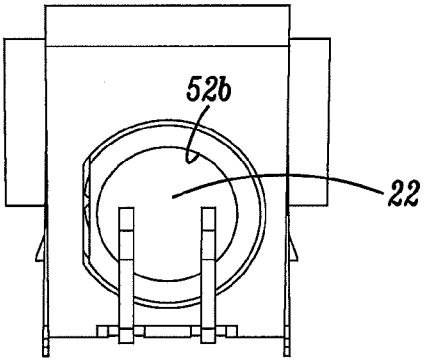
FIG. 13 is an emitter end view of the optical block of FIG. 11.
Figure 14:
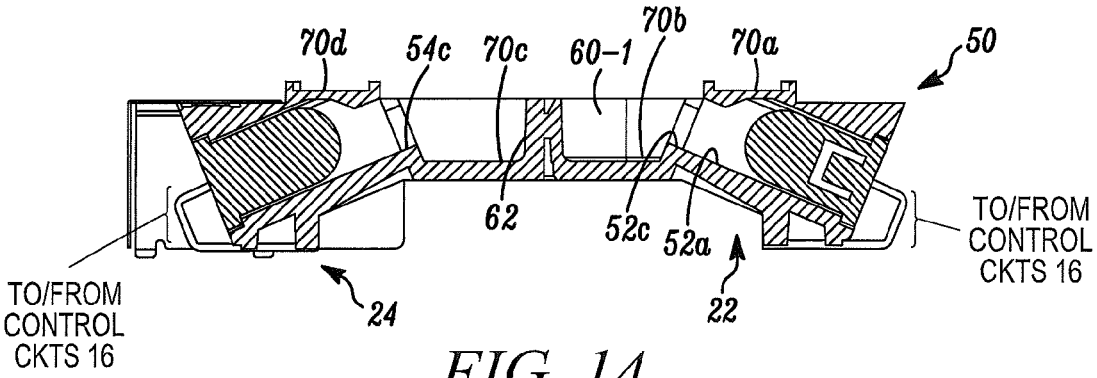
FIG. 14 is a sectional view taken along plane 14-14 of FIG. 12.
Figure 15:
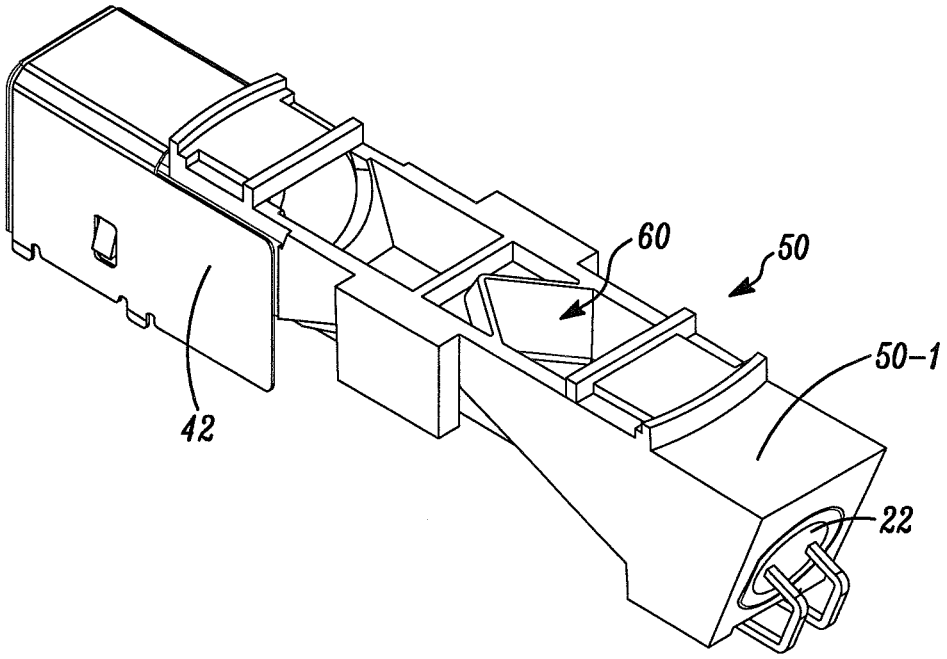
FIG. 15 is a perspective view of the optical block of FIG. 11.
Figure 16:
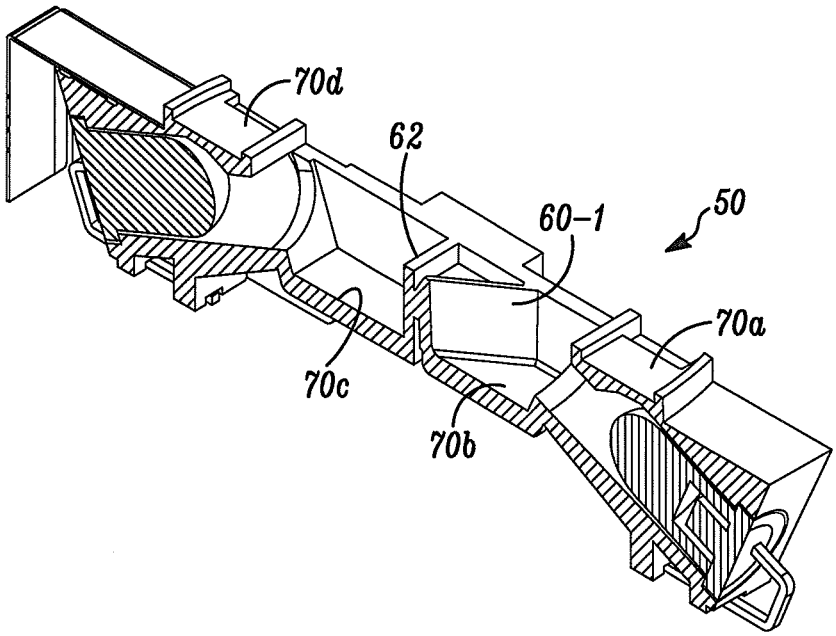
FIG. 16 is a sectional view taken along plane 16-16 of FIG. 12.
Figure 17:
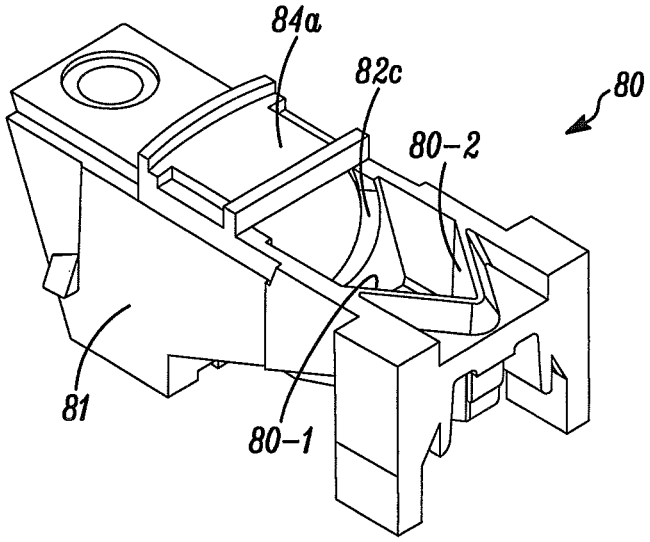
FIG. 17 is a perspective view of a single ended optical block.
Figure 18:
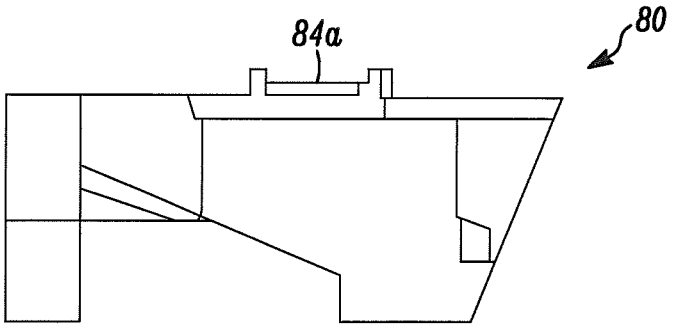
FIG. 18 is a side view of the single ended optical block of FIG. 17.
Figure 19:
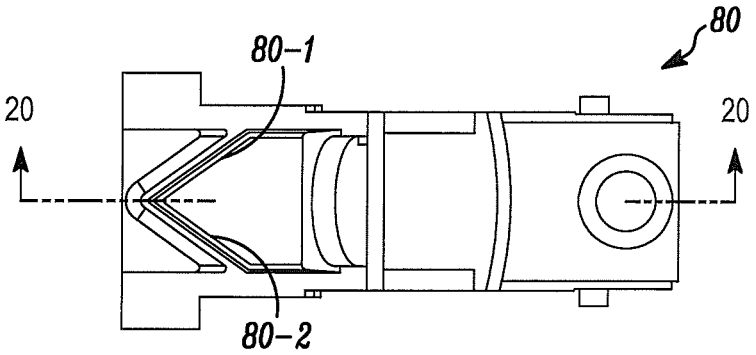
FIG. 19 is a top plan view of the single ended optical block of FIG. 17.
Figure 20:
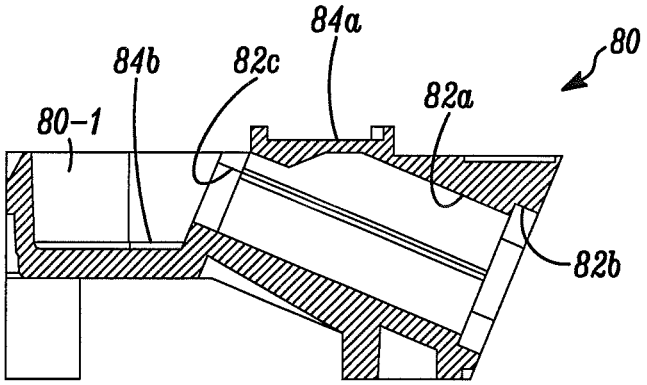
FIG. 20 is a side sectional view of the single ended optical block of FIG. 17 taken along plane 20-20 of FIG. 19.
Figure 21:
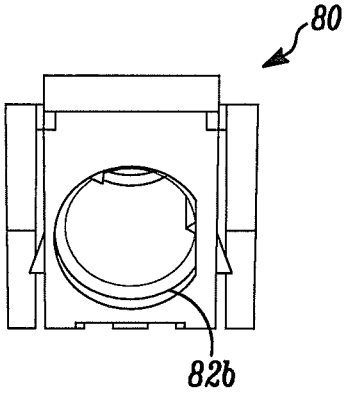
FIG. 21 is an end view of the single ended optical block of FIG. 17.
Figure 22:
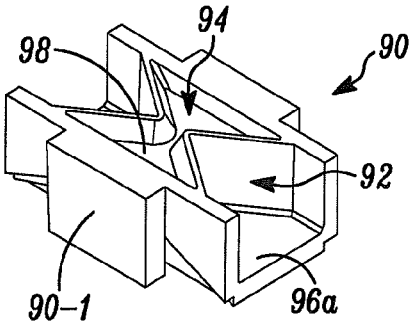
FIG. 22 is a perspective view of a barrier only optical block.
Figure 23:
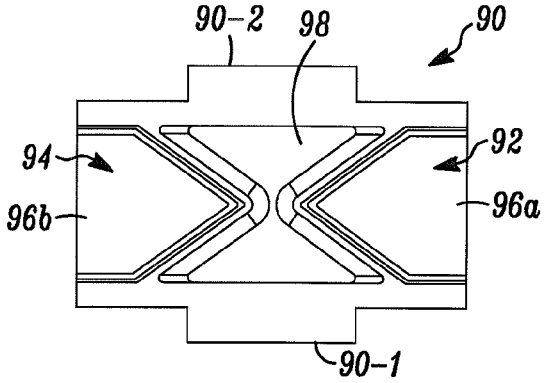
FIG. 23 is a top plan view of the barrier only optical block of FIG. 22.
Figure 24:
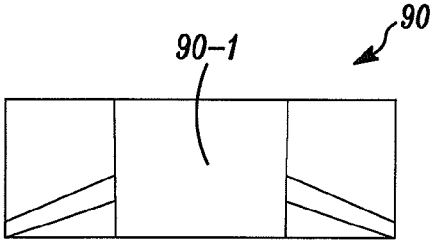
FIG. 24 is a side view of the barrier only optical block of FIG. 22.
Figure 25:
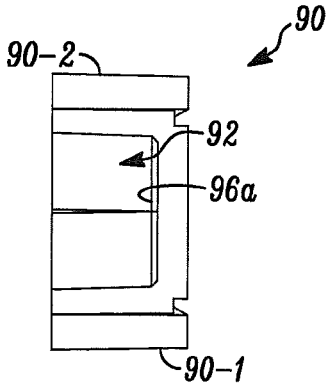
FIG. 25 is an end view of the barrier only optical block of FIG. 22.

FIG. 10 illustrates the optical block 20 with the shield 42 removed. While the shield has been illustrated in connection with the receiver 24, it will be understood that the shield could also be used with the emitter 22. Alternately, the shield 42 could be omitted as illustrated in FIG. 10. It will be understood that neither the shield 42 nor its absence are limitations hereof.

FIGS. 11-16 illustrate various aspects of an alternate form of an optical block 50. Elements previously described that appear in FIGS. 11-16 have been assigned the same identification numerals and need not be described further.

The optical block 50 is substantially the same as the optical block 20 except that the optical block 50 includes only a single V-shaped barrier/reflector combination 60. Such a barrier element 60 has planar surfaces 60-1, 60-2 arranged in the same configuration as previously described in connection with the emitter barrier 30. Instead of a second V-shaped barrier element, the optical block 50 includes a planar surface 62 as seen FIG. 12 hereof.

The emitter 22 can be located on a side of the optical block 50 with the barrier element 60. The planar surface 62 can be located on a side of the optical block 50 associated with the receiver 24.

Planar pick surfaces 70*a*, 70*b*, 70*c*, and 7*d* are located on the optical block 50 as illustrated. The planar surface 62 is oriented so as to be substantially perpendicular to the planar pick surface 70*c* adjacent thereto. Alternately, the barrier element 60 could be located adjacent to the receiver 24.

FIGS. 17-21 illustrate a single ended alternate embodiment of an optical block 80. The optical block 80 has a body portion 80-1 with a channel 82*a*, an input port 82*b*, and output port 82*c* that can receive one of the emitter 22 or the receiver 24. A single barrier and reflector element 80-2 comparable to the element barrier 30 previously discussed is formed in the body portion 80-1.

A pair of separate optical blocks, such as the optical block 80, could be mounted on a base adjacent to a sensing chamber to form a smoke detector of the general type discussed above.

FIGS. 22-25 illustrate various views of a stand-alone modular barrier 90. The modular barrier 90 includes two molded barriers 92, 94 of the type previously discussed. A depressed region 98 is provided therebetween to collect dust, insects, or condensed drops of water generally as described above with respect to to optical block 20. The modular barrier 90 could be located between the emitter and the receiver to reduce an emitted light beam and to avoid direct illumination of the receiver.

In summary, optical barriers as described above can be molded of thermoplastic or thermosetting molding materials. A low cost mineral reinforced nylon resin, which can be injection molded by an application of heat and pressure to form parts with good mechanical properties, can be effectively used to manufacture the above described optical blocks.

Such optical blocks can carry and position optical emitters and receivers with a 5 mm (T 1¼) package, whose leads can be bent to facilitate an automatic mounting process of the optical blocks. The optical blocks can be scaled to use the optical emitters and receivers with a 3 mm package.

The optical blocks as described above are designed to be mounted on a support member, such as a printed circuit board using standard assembly processes.

The optical blocks as described above can be supplied in a tape and reel assembly in a dedicated feeder. The optical blocks can be fed to an automatic placement machine for mass production.

The automatic mounting process can include different stages as follows. During pick-up, a vacuum nozzle collects an optical block from a pick-up area, and a first vacuum check can be made to determine if the optical block has been picked up correctly. A camera inspection can be carried out. If a previous check passes, then a camera can measure the optical block and calculate any offset needed to place the optical block precisely. The optical block can be moved to the printed circuit board. A second vacuum check can be carried out to verify that the optical block is still on the vacuum nozzle. The optical block can be placed on the printed circuit board. The optical block can be directly mounted on the printed circuit board.

An emitter can be connected to a driver circuit that pulses it in order to generate light that can be projected into a sensing chamber. Some of that light is scattered by smoke particles onto a receiver, triggering an alarm signal.

The optical blocks and the sensing chamber as described above are designed so that, without smoke, only a small amount of the light from the emitter is scattered toward the receiver as compared to an amount of the light scattered by the smoke entering during a fire.

To complete an assembling process of a fire detector, the printed circuit board with the optical block is inserted between a detector base and plastic parts that form the sensing chamber. Finally, the sensing chamber can be bounded by a cover that might also carry an air inflow filter. The cover conveys the smoke into the sensing chamber.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. A detector comprising:

a source that emits a beam of first radiant energy toward a sensing chamber when energized;

a sensor that detects scattered radiant energy from the sensing chamber;

a support member coupled to the source and the sensor;

an emitter optical block coupled to the support member and having an emitter body to support the source and at least one emitter optical barrier that is formed integral with the emitter body; and a receiver optical block coupled to the support member and having a receiver body to support the sensor and at least one receiver optical barrier that is formed integral with the receiver body, wherein each of the emitter optical barrier and the receiver optical barrier includes first and second elongated planar segments formed in a respective one of the emitter body and the receiver body, wherein the first and second elongated planar segments of the emitter optical block are formed in the emitter body of the emitter optical block so as to block, in part, the beam, wherein the first and second elongated planar segments of the receiver optical block are formed in the receiver body of the receiver optical block so as to block, in part, the scattered radiant energy, wherein the first and second elongated planar segments of the emitter optical block are joined to form the at least one emitter optical barrier in a first V shape, and wherein the first and second elongated planar segments of the receiver optical block are joined to form the at least one receiver optical barrier in a second V shape.

2. The detector as in claim 1 wherein portions of the support member between the source and the sensor are substantially symmetrical.

3. The detector as in claim 1 further comprising an electrical shield adjacent to the sensor.

4. The detector as in claim 1 further comprising a housing that carries the support member, the emitter optical block supporting the source, and the receiver optical block supporting the sensor, wherein the housing defines the sensing chamber as an internal space between the emitter optical block and the receiver optical block.

5. The detector as in claim 4 wherein the at least one emitter optical barrier of the emitter optical block has an emitter slope angle in a range of sixty degrees to ninety degrees relative to an emitter planar pick surface of the emitter optical block, and wherein the at least one receiver optical barrier of the receiver optical block has a receiver slope angle in the range of sixty degrees to ninety degrees relative to a receiver planar pick surface of the receiver optical block.

6. The detector as in claim 5 wherein each of the emitter slope angle and the receiver slope angle is ninety degrees.

7. The detector as in claim 1 wherein an emitter angle of the at least one emitter optical barrier in the first V shape is formed by the first and second elongated planar segments of the emitter optical block being in a range of forty five to ninety five degrees, and wherein a receiver angle of the at least one receiver optical barrier in the second V shape is formed by the first and second elongated planar segments of the receiver optical block being in the range of one hundred and ten degrees to forty five degrees.

8. The detector as in claim 1 further comprising a metallic shield that, in part, surrounds the sensor.

9. A detector comprising:

a molded module having a body;

a first spaced apart end portion integrally formed in the body of the molded module, wherein the first spaced apart end portion includes a first set of first and second planar surfaces joined at a first common line to form a first V-shaped barrier;

a second spaced apart end portion integrally formed in the body of the molded module, wherein the second spaced apart end portion includes a second set of first and second planar surfaces joined at a second common line to form a second V-shaped barrier;

a source that directs a beam of first radiant energy toward the first spaced apart end portion;

a receiver that detects scattered incident radiant energy reflected from the second spaced apart end portion: and a depressed region disposed between the first spaced apart end portion and the second spaced apart end portion, wherein the first V-shaped barrier blocks, in part, the beam, and wherein the second V-shaped barrier blocks, in part, the scattered incident radiant energy.

10. The detector as in claim 9 wherein the first set of first and second planar surfaces are oriented at an angle on an order of seventy degrees relative to one another, and wherein the second set of first and second planar surfaces are oriented at the angle on the order of seventy degrees relative to one another.

11. A detector comprising;

an optical block that has a body, an emitter zone, and a receiver zone with a central section there between, wherein the central section includes first and second spaced apart barriers formed integral with the body, wherein the first spaced apart barrier is oriented to receive first radiant energy from the emitter zone, wherein the second spaced apart barrier is oriented to receive second radiant energy scattered toward the receiver zone, wherein each of the first and second spaced apart barriers is oriented at a respective slope angle in a range of sixty degrees to ninety degrees with respect to a respective planar surface of the emitter zone and the receiver zone, wherein the first spaced apart barrier includes a first set of first and second planar members joined together to form a first V-shape that blocks, in part, the first radiant energy from the emitter zone, and wherein the second spaced apart barrier includes a second set of first and second planar members joined together to form a second V-shape that blocks, in part, the second radiant energy scattered toward the receiver zone.

12. The detector as in claim 11 wherein the first set of first and second planar members are joined together to form the first V-shape at a first shaped angle relative to one another in the range of seventy degrees plus or minus twenty five degrees, and wherein the second set of first and second planar members are joined together to form the second V-shape at a second shaped angle relative to one another in the range of seventy degrees plus or minus twenty five degrees.

13. The detector as in claim 12 wherein the central section includes a depressed region disposed between the first and second spaced apart barriers.

* * * * *